US007765612B2

(12) United States Patent
Waters et al.

(10) Patent No.: US 7,765,612 B2
(45) Date of Patent: Aug. 3, 2010

(54) PROTECTIVE GARMENT FOR USE BY A FIREFIGHTER OR OTHER EMERGENCY WORKER WEARING A WEIGHT-BEARING HARNESS OVER THE EXTERIOR OF THE PROTECTIVE GARMENT

(75) Inventors: Patricia K. Waters, Tipp City, OH (US); Mary I. Grilliot, Dayton, OH (US); William L. Grilliot, Dayton, OH (US); William L. Grilliot, Jr., Dayton, OH (US)

(73) Assignee: Horning Pride Manufacturing, L.L.C., Dayton, OH (US)

( * ) Notice: Subject to any disclaimer, the term of this patent is extended or adjusted under 35 U.S.C. 154(b) by 274 days.

(21) Appl. No.: 11/903,108

(22) Filed: Sep. 20, 2007

(65) Prior Publication Data

US 2009/0077709 A1 Mar. 26, 2009

(51) Int. Cl.
*A62B 17/00* (2006.01)

(52) U.S. Cl. ..... 2/97

(58) Field of Classification Search ..... 2/69, 2/94, 79, 102, 81, 456, 97; 244/151 R; 182/3–6
See application file for complete search history.

(56) References Cited

U.S. PATENT DOCUMENTS

| | | | | |
|---|---|---|---|---|
| 6,339,843 | B1 | 1/2002 | Grilliot et al. | |
| 6,658,666 | B2 * | 12/2003 | Schweer | 2/94 |
| 6,698,026 | B2 * | 3/2004 | Schweer | 2/94 |
| 6,745,405 | B2 | 6/2004 | Blauer et al. | |
| 6,892,395 | B2 * | 5/2005 | Schweer | 2/94 |
| 2007/0136923 | A1 | 6/2007 | Aldridge | |

* cited by examiner

*Primary Examiner*—Tejash Patel
(74) *Attorney, Agent, or Firm*—Wood, Phillips, Katz, Clark & Mortimer

(57) ABSTRACT

A protective garment (10) is provided for use by a firefighter or other emergency worker in connection with a weight-bearing harness (24, 30) worn by the firefighter or other emergency worker over the exterior of the protective garment (10). The protective garment (10) includes an outer shell (40), a moisture barrier liner (42) within the outer shell (40). The protective garment (10) is constructed of first and second moisture barrier materials (50, 51), with the first moisture barrier material (50) having superior wear resistance in comparison to the second moisture barrier material (51). The first moisture barrier material (50) is utilized in areas requiring additional wear protection.

14 Claims, 1 Drawing Sheet

PROTECTIVE GARMENT FOR USE BY A FIREFIGHTER OR OTHER EMERGENCY WORKER WEARING A WEIGHT-BEARING HARNESS OVER THE EXTERIOR OF THE PROTECTIVE GARMENT

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to protective garments worn by firefighters and other emergency workers and to weight-bearing harnesses such as are used with a self-contained breathing apparatus (SCBA) and/or climbing or fall protection harnesses.

BACKGROUND OF THE INVENTION

It is common for firefighters and other emergency workers to wear a self-contained breathing apparatus (SCBA) having an air tank that is carried on the back of the firefighter by a harness that will typically include shoulder straps and a waist strap worn over the coat of their turnout gear. It is also common for firefighters to wear a climbing or fall protection harness over the pants of their turnout gear. One problem that can occasionally occur is wear in the portions of the protective coat or pants that underlie and support the harnesses due to the weight and rubbing of the straps of the harness. This is particularly a problem with the moisture barrier liners of such garments, which do not have the same durability and/or wear resistance as the outer shell of the garment.

SUMMARY OF THE INVENTION

In accordance with one feature of the inventions, a protective garment is provided for use by a firefighter or other emergency worker in connection with a weight-bearing harness worn by the firefighter or other emergency worker over the exterior of the protective garment. The protective garment includes an outer shell and a moisture barrier liner within the outer shell. The moisture barrier liner is constructed from first and second moisture barrier materials, with the first moisture barrier material having a superior wear resistance in comparison to the second moisture barrier material. The moisture barrier liner has at least one wear reduction zone located to underlie the harness when worn by a firefighter or other emergency worker and constructed from the first material. A remainder of the moisture barrier liner is constructed from the second material, with the first and second material being connected to each other at adjoining perimeters of the at least one wear reduction zone and the remainder to form a continuous moisture barrier.

As one feature, the protective garment is a coat and the wear reduction zone is located in at least one of a waist portion of the coat to underlie a waist harness and a shoulder portion of the coat to underlie a shoulder harness.

In one feature, the wear reduction zone extends downward from the waist portion to adjacent a bottom of the coat.

According to one feature, the coat has a collar and a pair of sleeves and the wear reduction zone extends from the collar to each of the sleeves.

As one feature, the protective garment is a pair of pants and the wear reduction zone is located in at least one of a waist portion of the pair of pants and a pair of upper thigh portions of the pair of pants.

In one feature, the wear reduction zone is located in the waist portion of the pair of pants.

As one feature, the wear reduction zone extends from the waist portion to a pair of upper thigh portions of the pair of pants.

In accordance with one feature of the invention, a moisture barrier liner is provided for a protective garment for use by a firefighter or other emergency worker in connection with a weight-bearing harness worn by the firefighter of other emergency worker over the exterior of the protective garment. The moisture barrier liner is constructed from first and second moisture barrier materials, with the first moisture barrier material having a superior wear resistance in comparison to the second moisture barrier material. The moisture barrier liner has at least one wear reduction zone located to underlie the harness when worn by a firefighter or other emergency worker and constructed from the first material. A remainder of the moisture barrier liner is made from the second material, with the first and second material being connected to each other at adjoining perimeters of the at least one wear reduction zone and the remainder to form a continuous moisture barrier.

In one feature, the moisture barrier liner is a coat liner and the wear reduction zone is located in at least one of a waist portion of the coat to underlie a waist harness and a shoulder portion of the coat to underlie a shoulder harness.

As one feature, the wear reduction zone extends downward from the waist portion to adjacent a bottom of the coat.

According to one feature, the coat liner has a collar portion and a pair of sleeves and the wear reduction zone extends from the collar portion to each of the sleeves.

In one feature, the moisture barrier liner is a pant liner and the wear reduction zone is located in at least one of a waist portion of the pant liner and a pair of upper thigh portions of the pant liner.

As one feature, the wear reduction zone is located in the waist portion of the pant liner.

In one feature, the wear reduction zone extends from the waist portion to a pair of upper thigh portions of the pant liner.

Other objects, features, and advantages of the invention will become apparent from a review of the entire specification, including the appended claims and drawings.

DETAILED DESCRIPTION OF THE PREFERRED EMBODIMENT

Figure 1:
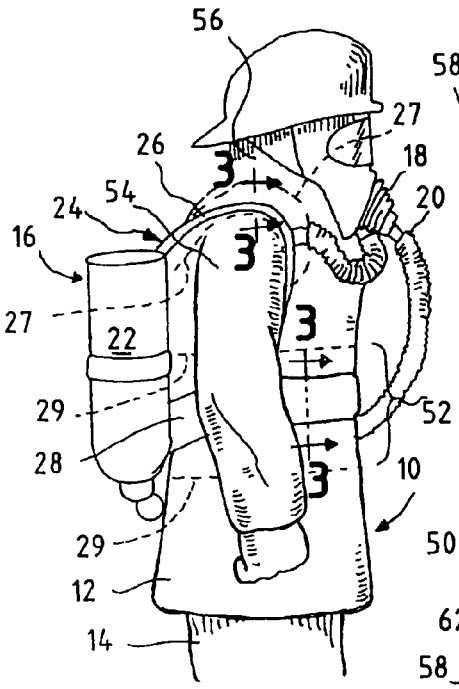
FIG. 1 is a perspective view from the side of a fireman or other emergency worker wearing protective garments embodying the present invention, as well as a SCBA.
Figure 2:
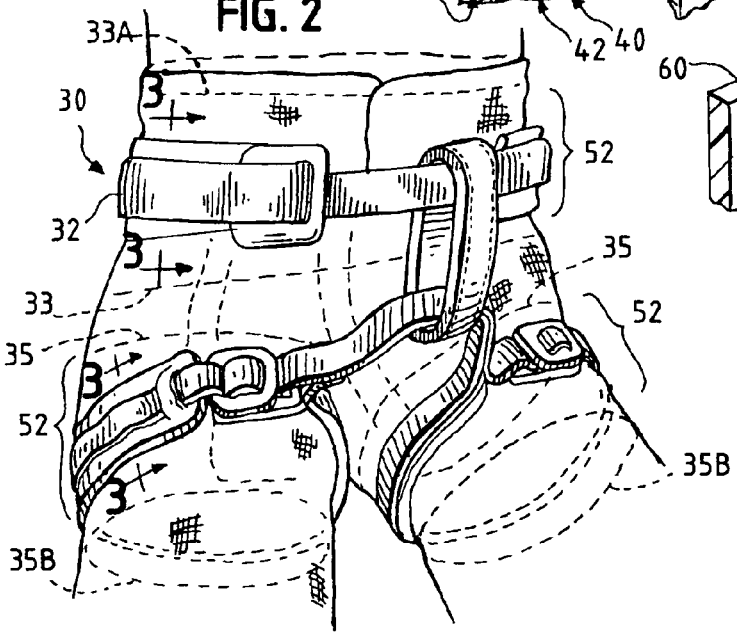
FIG. 2 is a perspective view from the front of the fireman of FIG. 1 showing the pair of pants of the protective garments with a climbing or fall protection harness worn over the pair of pants.

With reference to FIGS. 1 and 2, a firefighter or other emergency worker is shown wearing protective garments 10 in the form of a coat 12 and pair of pants 14. As seen in FIG. 1, the firefighter is wearing a self-contained breathing apparatus 16 that includes a respirator 18 connected by a hose 20 to an oxygen/air tank 22 that is carried on the back of the firefighter by a harness 24. The harness 24 includes a pair of shoulder straps 26 (only one shown in FIG. 1), each extending over a corresponding shoulder portion of the coat generally indicated by dashed lines 27, and a waist strap 28 extending over a waist portion of the coat generally indicated by dashed lines 29. With reference to FIG. 2, it can be seen that the firefighter is wearing a climbing or fall protection harness 30 that includes a waist strap 32 extending around a waist portion of the pair of pants generally indicated by dashed lines 33, and a pair of upper thigh straps 34 extending over an upper thigh portion of the pair of pants 14 generally indicated by dashed lines 35.

Figure 3:
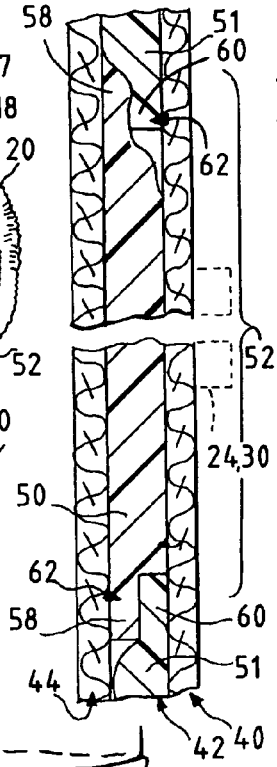
FIG. 3 is a section view taken along any of the section lines 3-3 in FIGS. 1 and 2.
Figure 4:
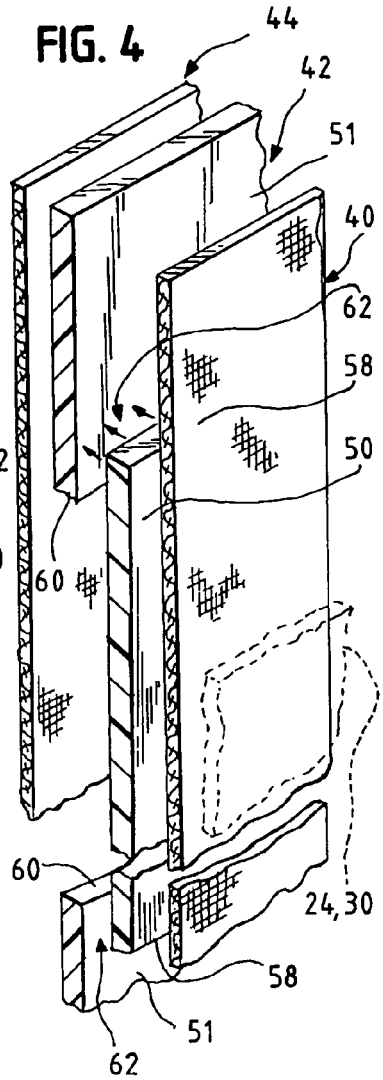
FIG. 4 is an exploded perspective view of FIG. 3.

With reference to FIGS. 3 and 4, both the coat 12 and the pair of pants 14 are of a multi-layered construction consisting of an outer shell 40, a moisture barrier liner 42, and optionally, but preferred, a thermal insulating barrier lining 44. Each of the layers 40, 42 and 44 can be made from suitable fabrics for each of their particular functions, many of which are known. For example, the outer shell 40 can be made from any suitable fire resistant, thermal resistant, and/or wear resistant (i.e., resistant to cuts, snags, tears, and abrasions) material, some examples of which include Kevlar®, Nomex®, Basofil, PBI (polybenzimidazole), and PBO (poly(p-phenylene-benzobisoxazole)) materials. The thermal insulative liner 44 can be made of a suitable thermal insulating material or construction, such as nonwoven batting, closed cell foam, and Basofil/Aramid batting sandwiched between face layers of a suitable breathable fabric.

The moisture barrier 42 is constructed from first and second moisture barrier materials 50 and 51, with the first moisture barrier material 50 having a superior wear resistance in comparison to the second moisture barrier material 52. Any suitable material that will be highly resistant to the passage of liquid, particularly liquid water, through the material, can be used for the moisture barrier materials 50 and 51. One possible example for the first moisture barrier material 50 would be the fabric supplied by W. L. Gore & Associates, Inc. under the Crosstech® trademark in its three-layer laminate form, with the second moisture barrier material possibly being Crosstech® fabric in its two-layer laminate form or some other suitable moisture barrier material. Additionally, the moisture barrier materials 50 and 51 can also be highly resistant to chemicals so that they act also as a chemical barrier. One example of such a material is supplied by W.L. Gore & Associates, Inc. under the CHEMPAK® trademark.

The first moisture barrier material 50 is used to construct one or more wear reduction zones 52 that underlie the harness 24 or 30, with the remaining portions of the garments 10 that do not underlie the harnesses 24 or 30 being constructed from the second moisture barrier material 51. It should be noted that the zones 52 will preferably be larger than the associated straps 26,28,32,34 to allow for variability in positioning of the harnesses 24 and 30 on the fireman which will naturally occur during use, and from one use to the next of the harness 24 or 30. In this regard, for the illustrated embodiments, the zones 52 can be considered as being defined between the dashed lines 27 for the shoulder strap 26 of the harness 24, between the dashed lines 29 for the waist strap 28 of the harness 24, between the dashed lines 33 for the waist strap 32 of the harness 30, and between the dashed lines 35 for the thigh straps 34 for the harness 30. It should be appreciated that other zones 52 are possible depending upon the particular construction of a harness. Furthermore, it will be appreciated that the zones 52 may only be required in only part of the area of the garment 10 that underlies a particular harness. For example, the first moisture barrier material 50 for use in connection with the shoulder strap 26 of the harness 24 may only be required in a part of the coat 12 that extends from the sleeves 54 of the coat 12 to the collar 56 of the coat 12. On the other hand, again depending upon the particular construction of the harness, it may be convenient to extend the first moisture barrier material 50 between closely adjacent zones 52. For example, for the harness 30 shown in FIG. 2, it may be convenient for the first moisture barrier material 50 to be provided between the upper line 33A and the lower lines 35B so as to define a boxer short-shaped zone 52 that would underlie the entire harness 30. In any event, it is preferred that the first moisture barrier material 50 be limited to only those portions of the garments 10 that require additional wear protection so that the majority of the garments 10 are constructed from the second moisture barrier material 51.

As best seen in FIGS. 3 and 4, the first and second moisture barrier materials 50 and 51 have adjoining perimeters 58 and 60, respectively, which are fixed to each other to form sealed seams 62, thereby providing a continuous moisture barrier for the garments 10. Any suitable method can be used for making the seams 62 including bonding the perimeters 58 and 60 together using heat and/or adhesive and/or stitching the perimeters 58 and 60 together in combination with a suitable seam sealing tape or other type of seam sealant. It should be appreciated that the particular construction illustrated in FIG. 3 is for illustration purposes only and that any suitable type of seam connection can be made between the two materials 50 and 51, including seams 62 wherein the perimeters 58 and 60 are folded onto each other to form a multi-layered seam for additional strength.

It should be appreciated that to provide superior wear resistance, the first barrier moisture material 50 will typically be more expensive than the second moisture barrier material 51. Accordingly, by providing the first moisture barrier material 50 in those areas that require additional wear protection, while using the second moisture barrier material 51 for the remainder of the moisture barrier liner 44, the cost associated with manufacturing the moisture barrier liner 44 can be reduced. Furthermore, for breathable type moisture barrier materials, the superior wear resistance of the first moisture barrier material 50 may result in the material 50 being inferior to the breathability of the second moisture barrier material 51. The moisture barrier liner 44 can provide for optimized breathability and wear resistance by utilizing the first moisture barrier material 50 in those areas that require additional wear protection, while using the second moisture barrier material 51 for the remainder of the moisture barrier liner 44.

The invention claimed is:

1. A protective garment for use by a firefighter or other emergency worker in connection with a weight-bearing harness worn by the firefighter or other emergency worker over the exterior of the protective garment, the protective garment comprising:

an outer shell; and a moisture barrier liner within the outer shell, the moisture barrier liner constructed from first and second moisture barrier materials, the first moisture barrier material having a superior wear resistance in comparison to the second moisture barrier material, the moisture barrier liner having at least one wear reduction zone located to underlie the harness when worn by a firefighter or other emergency worker and constructed from the first material, with a remainder of the moisture barrier liner being constructed from the second material, the first and second materials connected to each other at adjoining perimeters of the first and second materials to form a continuous moisture barrier.

2. The protective garment of claim 1 wherein the protective garment is a coat and the wear reduction zone is located in at least one of a waist portion of the coat to underlie a waist harness and a shoulder portion of the coat to underlie a shoulder harness.

3. The protective garment of claim 2 wherein the wear reduction zone extends downward from the waist portion to adjacent a bottom of the coat.

4. The protective garment of claim 2 wherein the coat has a collar and a pair of sleeves and the wear reduction zone extends from the collar to each of the sleeves.

5. The protective garment of claim 1 wherein the protective garment is a pair of pants and the wear reduction zone is located in at least one of a waist portion of the pair of pants and a pair of upper thigh portions of the pair of pants.

6. The protective garment of claim 5 wherein the wear reduction zone is located in the waist portion.

7. The protective garment of claim 6 wherein the wear reduction zone extends from the waist portion to a pair of upper thigh portions of the pair of pants.

8. A moisture barrier liner for a protective garment for use by a firefighter or other emergency worker in connection with a weight-bearing harness worn by the firefighter of other emergency worker over the exterior of the protective garment, the moisture barrier liner constructed from first and second moisture barrier materials, the first moisture barrier material having a superior wear resistance in comparison to the second moisture barrier material, the moisture barrier liner having at least one wear reduction zone located to underlie the harness when worn by a firefighter or other emergency worker and constructed from the first material, with a remainder of the moisture barrier liner being made from the second material, the first and second materials connected to each other at adjoining perimeters of the first and second materials to form a continuous moisture barrier.

9. The moisture barrier liner of claim 1 wherein the moisture barrier liner is a coat liner and the wear reduction zone is located in at least one of a waist portion of the coat to underlie a waist harness and a shoulder portion of the coat to underlie a shoulder harness.

10. The moisture barrier liner of claim 9 wherein the wear reduction zone extends downward from the waist portion to adjacent a bottom of the coat.

11. The moisture barrier liner of claim 10 wherein the coat liner has a collar portion and a pair of sleeves and the wear reduction zone extends from the collar portion to each of the sleeves.

12. The moisture barrier liner of claim 9 wherein the moisture barrier liner is a pant liner and the wear reduction zone is located in at least one of a waist portion of the pant liner and a pair of upper thigh portions of the pant liner.

13. The moisture barrier liner of claim 12 wherein the wear reduction zone is located in the waist portion.

14. The moisture barrier liner of claim 13 wherein the wear reduction zone extends from the waist portion to a pair of upper thigh portions of the pant liner.

* * * * *